US010508451B2

(12) United States Patent
Rotter

(10) Patent No.: US 10,508,451 B2
(45) **Date of Patent: *Dec. 17, 2019**

(54) HIP AND RIDGE VENT

(71) Applicant: Martin J. Rotter, Glenside, PA (US)

(72) Inventor: Martin J. Rotter, Glenside, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/611,063

(22) Filed: Jun. 1, 2017

(65) Prior Publication Data

US 2017/0350132 A1 Dec. 7, 2017

Related U.S. Application Data

(60) Provisional application No. 62/344,023, filed on Jun. 1, 2016.

(51) Int. Cl.
*E04D 13/17* (2006.01)
*E04D 3/30* (2006.01)

(52) U.S. Cl.
CPC ..... *E04D 13/174* (2013.01); *E04D 3/30* (2013.01); *E04D 13/172* (2013.01)

(58) Field of Classification Search
CPC ..... E04D 13/174; E04D 3/30; E04D 13/172
USPC ..... 52/199
See application file for complete search history.

(56) References Cited

U.S. PATENT DOCUMENTS 4,335,555 A * 6/1982 Southerland ..... E04B 1/2608 403/190
4,658,552 A * 4/1987 Mulford ..... E04B 2/706 454/185
4,815,250 A * 3/1989 Mulford ..... E04B 2/706 269/910
5,094,059 A * 3/1992 Ganescu ..... E04B 1/3441 16/371
5,143,170 A * 9/1992 Hunt ..... A62B 35/04 182/3
5,167,579 A * 12/1992 Rotter ..... E04D 1/36 454/365
5,535,558 A * 7/1996 Rieke ..... B29C 53/04 454/365
5,561,953 A 10/1996 Rotter
5,960,595 A * 10/1999 McCorsley, III ..... B32B 3/30 52/199
5,971,848 A * 10/1999 Nair ..... F24F 7/02 454/365
6,015,343 A * 1/2000 Castillo ..... E04D 13/174 454/365

(Continued)

*Primary Examiner* — Jeanette E Chapman
(74) *Attorney, Agent, or Firm* — Volpe and Koenig, P.C.

(57) ABSTRACT

A roof ridge and hip ridge vent system for contoured roofs which include a vent slot located through the roof structure. A contoured roofing material forms the roof surface. Vent strips are provided on the roof surface that extend on each side of the vent slot. The vent strip is comprised of synthetic fibers that are randomly aligned into an open web by an air flow and then joined by a phenolic or latex binder to form an air permeable mesh material having a generally uniform thickness, a density of about 0.08 to 0.1 grams per cubic centimeter (1.3 to 1.6 grams per cubic inch), and a crush recovery of at least 80%. A first longitudinally extending groove extends from the bottom surface about 40% to 60% of a height of the vent strip and is located a distance of at least about 1 inch from a downslope side.

6 Claims, 4 Drawing Sheets

(56) References Cited

U.S. PATENT DOCUMENTS 6,361,434 B1 * 3/2002 Brandon ..... E04D 13/176 454/365
6,487,826 B1 * 12/2002 McCorsley ..... E04D 13/152 52/309.1
6,565,431 B1 * 5/2003 Villela ..... F24F 7/02 454/365
7,222,463 B2 * 5/2007 Rotter ..... E04D 13/174 454/365
8,393,943 B2 3/2013 Rotter
10,113,760 B2 * 10/2018 Rotter ..... F24F 7/02
2005/0054284 A1 * 3/2005 Ciepliski ..... E04D 13/176 454/365
2005/0090197 A1 * 4/2005 Coulton ..... E04D 13/176 454/365
2005/0126088 A1 * 6/2005 Rotter ..... E04D 1/36 52/198
2005/0239392 A1 * 10/2005 Sells ..... E04D 1/36 454/165
2006/0079173 A1 * 4/2006 Coulton ..... E04D 13/176 454/365
2006/0230707 A1 * 10/2006 Roe ..... E04D 13/172 52/794.1
2007/0000192 A1 * 1/2007 Mantyla ..... E04D 13/174 52/199
2008/0220714 A1 * 9/2008 Caruso ..... E04D 13/152 454/365
2008/0287053 A1 * 11/2008 Carlson ..... E04D 13/174 454/365
2008/0287054 A1 * 11/2008 Carlson ..... E04D 13/174 454/365
2010/0043311 A1 * 2/2010 Chich ..... E04D 13/152 52/95
2012/0164428 A1 * 6/2012 Burgess ..... E04B 1/88 428/292.1
2014/0013688 A1 * 1/2014 Pollack ..... D04H 1/4266 52/302.1
2016/0053493 A1 * 2/2016 Rotter ..... E04D 13/174 52/198
2017/0276388 A1 * 9/2017 Rotter ..... E04D 13/174
2018/0038112 A1 * 2/2018 Holland ..... E04D 13/176

* cited by examiner

HIP AND RIDGE VENT

INCORPORATION BY REFERENCE

The following documents are incorporated herein by reference as if fully set forth: U.S. Provisional Patent Application No. 62/344,023, filed Jun. 1, 2016.

FIELD OF THE INVENTION

The present invention relates to a roof ridge and hip ridge vent for use on contoured tile and metal roof panels.

BACKGROUND

In general, roof ridge vents work in conjunction with soffit vents in order to allow air to flow beneath the roof to provide passive ventilation. As hot stale air is withdrawn from the ridge slot vent by convection and/or wind suction, it is replaced by fresh ambient air through the soffit vents. This equalization inhibits moisture from condensing on insulation and wood roofing materials which causes mildew and rot, prevents build-up of ice dams which could buckle shingles and gutters, and reduces air-conditioning costs when hot attic air is replaced by cooler ambient air.

It has been known to ventilate attics under gable roofs made of contoured metal panels by running a vent along the roof ridge that is in communication with a slot or ridge opening that connects to the attic or under-roof space. A highly successful one of such vents which is manufactured and sold under the name "PROFILEVENT" is described in U.S. Pat. No. 5,561,953, which is incorporated by reference herein as if fully set forth, in which the contour of the metal roofing panel is cut into a non-woven strip of vent material. The vent material in this product is required to be stiff enough to hold its shape and resist crushing when the ridge cap is installed by nailing through the ridge cap and the vent material so that the net free area of the vent material is not diminished. The material is fire retardant, and the configuration is such that it prevents the ingress of wind driven-rain within the limits of the applicable building standards, and also prevents the ingress of debris and insects. To the extent that moisture penetrates into the non-woven material, it is freely draining so that it does not trap moisture against the metal roof panels which can occur with some of the known open cell foam vent products, which causes corrosion of the roof panels themselves, requiring costly repair or replacement. Further, this known product is UV stable and does not break down due to sunlight or environmental factors, such as hot and cold temperature exposure, which is an issue with some other ridge vent products made of open cell foam.

However, a drawback of the known "PROFILEVENT" material is that the profile is matched to the contoured roof panel in a direction parallel to the ridge, i.e., generally perpendicular to a direction that the contours or ribs of the roof panels extend. This does not allow the product to be used with a hip ridge vent, due to the angle it makes relative to the contoured roof panels, which can vary depending on the roof pitch, direction of the hip ridge, etc. This can result in insufficient ridge length being available for venting. Additionally, even with gable ridge vents, there is a higher cost involved with having to create vent material with the correct profile to match the known panel contours, as well as having to carry an inventory of vent material specific for each of such panel types.

Other known ridge vents use a porous foam strip or a non-woven mesh strip having enhanced flexibility that are compressed by the ridge cap to match a roof profile, for example of standing seam metal roofs. These arrangements can suffer issues with water retention causing roof decay in the case of foam, and incomplete filling of the profiled gap between the roof surface and the cap in which the ridge vent is installed for the non-woven mesh. Further, the enhanced flexibility of the non-woven mesh is due to the use of less fiber or smaller deniers of fiber and a reduced volume or more elastic binder to allow compressibility. This introduces additional issues with respect to the ability of the non-woven vent strip to prevent the entry of wind driven rain (WDR) as well as up slope-driven rain (USR) due to the more open non-woven material required for conformability as well as capillary action carrying moisture along the fibers, all of which can result in leakage through the vent.

SUMMARY

Briefly stated, the present invention provides a roof ridge and hip ridge vent system for contoured roofs which include a vent slot located through the roof structure along at least one of a roof ridge or hip ridge. A contoured roofing material having upwardly directed projections and valleys between the projections forms the roof surface. The projections preferably have a height of about 0.8 inches or less. Vent strips are provided having top and bottom surfaces, with the bottom surface being located on the roof surface, with a respective one of the vent strips extending on each side of the vent slot. The vent strip is comprised of synthetic fibers that are randomly aligned into an open web by an air flow and then joined by a phenolic or latex binder that is heat cured to form an air permeable mesh material having a generally uniform height, preferably in the range of 0.9 to 1.2 inches for a roofing sheet with 0.8 inch high ribs or projections, a density of about 0.08 to 0.1 grams per cubic centimeter (1.3 to 1.6 grams per cubic inch), and a crush recovery of at least 80%. The vent strip has a width of about 2 inches or more, and a longitudinally extending groove, arranged parallel to the hip or ridge, extending from the bottom surface about 40% to 60% of the height, and more particularly about 50% of the height. The groove has a groove width that is at least about 0.12 inches to about 0.25 inches and is located at least about 1 inch from a downslope side of the vent strip. The vent strip is resiliently compressible such that a space between the projections in the contoured roofing material is filled with the vent strip, and a portion of the strip is compressed into contact with and extends over the projections, at least partially filling the groove in an area of the projections. A cap overlies the slot and the top surface of the vent strip.

For roofs having a pitch of at least 5/12, the width of the vent strip is preferably approximately 2 inches. For roofs having a pitch of less than 5/12, the vent strip can have a greater width, such as approximately 3 inches, and preferably two of the longitudinally extending grooves are provided extending from the bottom surface. The grooves are nominally spaced apart by 1 inch from one another, and the downslope groove is located at least about 1 inch from a downslope side of the vent strip.

The groove or grooves in the vent strip provide a capillary break as well as a stilling gap for drainage of WDR as well as any USR component, which based on gravity and the deceleration caused by the baffle effect of the vent strip results in the WDR and USR components that are not directly blocked by the material matrix settling below an upper edge of the groove or upslope located one of the grooves, which prevent further capillary migration of the water, which then drains downwardly out from the vent strip and down the roof.

Preferably, the roof and hip ridge vent system provides at least 28 square inches of net free area per lineal foot of ridge.

The vent strip can be provided in stick or roll form.

BRIEF DESCRIPTION OF THE DRAWINGS

The present invention will be explained in more detail in connection with the drawings in which presently preferred embodiments are shown.

In the drawings.

DETAILED DESCRIPTION OF THE PREFERRED EMBODIMENTS

Figure 1:
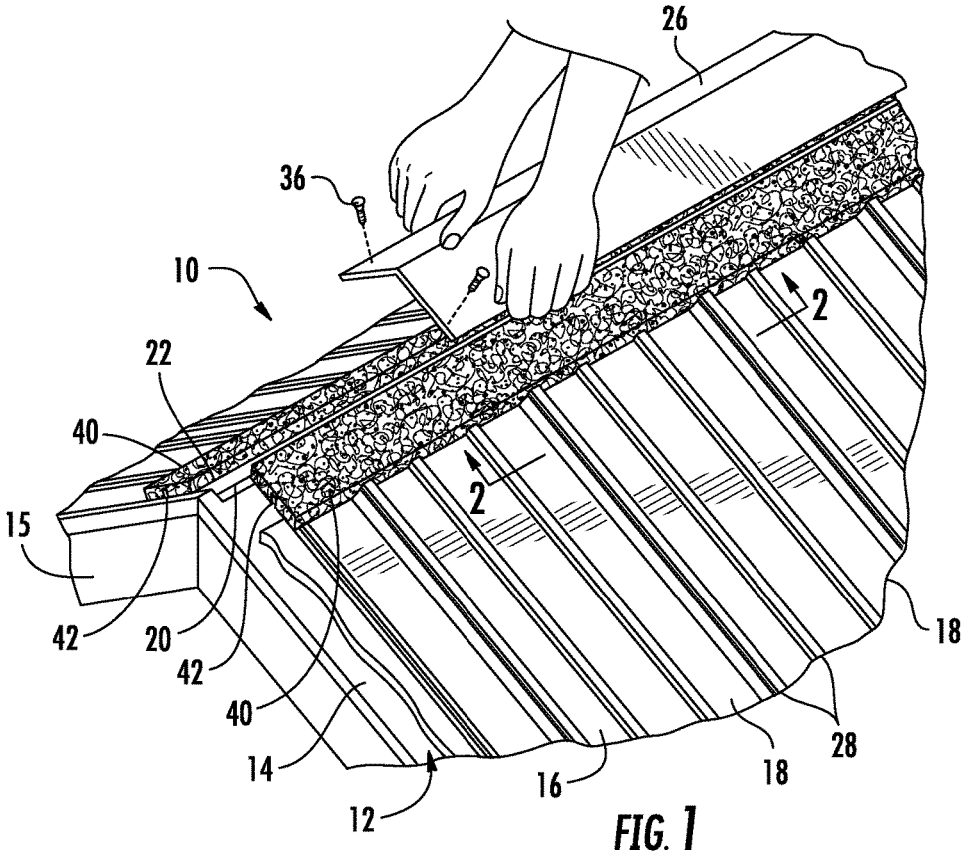
FIG. 1 is a perspective view of a portion of a roof ridge showing the installation of an embodiment of the roof ridge vent with an air-permeable resilient strip mounted on a metal roof.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention will be described with reference to the drawing figures wherein like numerals represent like elements throughout.

FIGS. 1-4 illustrates an embodiment of a roof venting system designated generally as 10. The roof venting system 10 is described in relation to a sloped roof 12 which may include rafters 15 that support decking 14 or purlins (not shown) that support a roofing material, such as a corrugated roofing sheet 16 formed by a plurality of metal or composite roofing panels 18. The roof 12 comes to a ridge 22 at a slope defined by its rafters 24.

The roofing panels 18 extend up to a vent slot 20 located at the ridge 22. A strip of venting material is installed either in one piece over the slot 20 such that it extends over the upper ends of the roofing panels 18 adjacent to the slot 20, or two separate strips 40 are installed, with one strip 40 being located over the upper ends of the roofing panels on each side of the slot 20. The roofing panels 18, the venting material strip(s) 40 and the vent slot 20 are covered with a ridge cap 26, usually made of similar material as the panels 18 and installed in sections running along the ridge 22.

The roofing panels 18 each have a plurality of projections 28 that project upwardly. As known to those in the art and shown in FIGS. 2 and 4, adjacent roofing panels 18 are joined together to form the sheet 16 by overlying a pair of lateral ends 38 from adjacent panels 18. In the exemplary embodiment shown, the projections 28 of the roofing panels 18 are both a larger stiffening rib 48 and a smaller squared stiffening rib 46. The larger stiffening ribs 48 in proximity to the lateral edges 38 are used to overlap the adjacent panel. However, other panel configurations can be used in conjunction with the vent strips 40.

Figure 6:
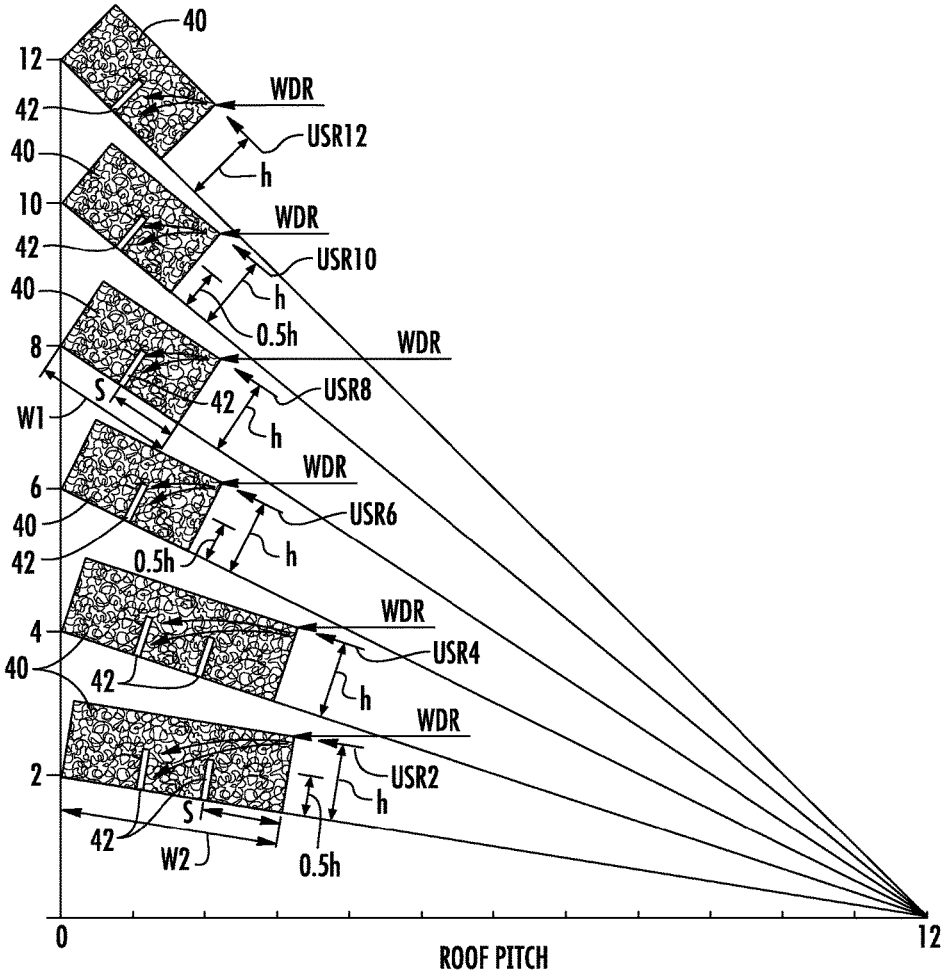
FIG. 6 is a diagram showing different vent strip configurations for different roof slopes.

Still with reference to FIGS. 1-4, the vent strip 40 is comprised of synthetic fibers that are randomly aligned into an open web by an air flow and then joined by a phenolic or latex binder that is heat cured to form an air permeable mesh material having a generally uniform height h, preferably in the range of 0.9 to 1.2 inches for a roofing sheet with 0.75 inch ribs, a density of about 0.08 to 0.1 grams per cubic centimeter (1.3 to 1.6 grams per cubic inch), and a crush recovery of at least 80%. Preferred fibers include 180 denier polyester, although other materials and deniers could be used. The fibers are preferably chopped to a length between 1 and 5 inches, and more preferably 1.5-2 inches. A preferred binder is a latex binder, such as those available from DOW Chemical, Rohm and Haas, and others. The width W1 in the illustrated embodiment is about 2 inches, although other widths could be used, depending on the application and roof slope. A longitudinally extending groove 42, arranged parallel to the ridge 22, extends up from the bottom surface about 40% to 60% of the height h, and more particularly about 50% of the height as indicated in FIG. 6, in an uninstalled state of the vent strip 40. The groove 42 has a groove width a that is at least about 0.12 inches to about 0.25 inches.

As shown in FIG. 6, for roofs having a 5/12 pitch or greater, preferably a single groove 42 is provided in the vent strip 40, preferably spaced a nominal distance S from the downslope side. For a width W1 of 2", S is preferably at least about 1". For roofs with a pitch of less than 5/12, the vent strip may be provided with a greater width W2, which is preferably 3", as represented in FIG. 6. Here, two grooves 42 are provided in the vent strip 40, with a nominal distance S of at least about 1" from the downslope side to the downslope groove 42, and also the nominal distance of S between the two grooves 42. Generally, the width of the vent strip 40 equals S*(number of grooves+1).

As illustrated in FIG. 6, the WDR (which is considered as being horizontal) and USR paths (indicated by roof slope as USR2, USR4, USR6, USR8, USR10, and USR12 which are parallel to the roof surface) for water that is not directly blocked by the material matrix of the vent strip 40 will generally intersect one of the grooves 42, which provide a capillary break as well as a stilling area for water to drop down to the roof surface rather than continuing to the vent slot 20 and entering the structure as a leak. The dashed horizontal line extending from WDR at each of the roof slopes illustrated is at the maximum WDR height in the vent strip, and the drop path is indicated by the lower curved arrow in each of the vent strips 40 represented. For the USR component of the rain, the velocity profile is lower higher from the roof surface, and the higher curved arrow in each of the illustrated vent strips 40 is shown. For lower roof pitches, it can be seen that the greater width W2 may be required based on the material matrix openness. For example for a 4/12 pitch, while the downslope groove 42 may have proven effective for WDR, the USR4 component could pass over the groove 42 and capillary action for the fibers in the material matrix of the vent strip 40 could carry water to the upslope side of the vent strip 40. It should be noted that the vent strip 40 cannot be used for 1/12 or lower pitched roofs.

While providing a greater width W2 for roofs with a slope less than 5/12 is preferred, this may not be required depending on the particular material matrix of the non-woven web forming the vent strip 40. Additionally, more grooves 42 could be provided in the vent strip 40 for enhanced conformability.

The vent strip 40 is resiliently compressible such that a space between the projections in the contoured roofing material is filled with the vent strip 40, and a portion of the strip 40 is compressed into contact with and extends over the projections 28 upon installation of the ridge cap 26. The vent material may be heat treated so that it "lofts" or expands, and then calendared down to a specific thickness to allow the completed vent strips to expand and conform to uneven surfaces when solar energy raises the roof temperature. The groove(s) 42 also provide additional space for the fibers of the matrix to be moved or compressed into in the areas over the stiffening ribs 46, 48. The compression of the vent strips 40 in these areas over the stiffening ribs 46, 48 results in a denser, less permeable arrangement of the fibers that acts as a direct material block for WDR and USR.

Figure 2:
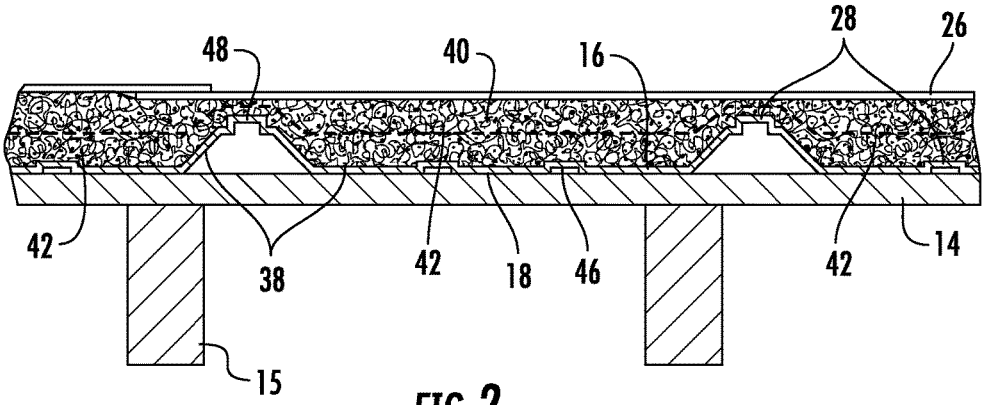
FIG. 2 is a cross-sectional view of the roof ridge vent illustrated in FIG. 1 and taken along line 2-2.
Figure 4:
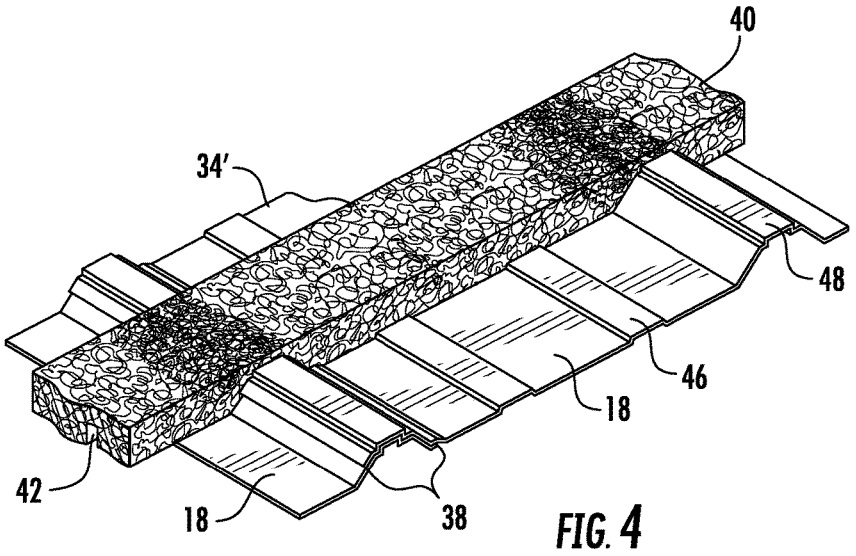
FIG. 4 is an enlarged perspective view of the air permeable and resilient strip on the metal roof showing the compression of the material at the rib or projection locations of the roof panel.

The vent strip 40 has at least a portion that is air permeable to allow the passage of air to ventilate the roof. The strip 40 completely fills the space between the panels 18 and the ridge cap 26 to prevent water, such as wind driven rain, from entering in accordance with building standards, but allows the passage of air. Preferably, the entire strip 40 is made from the air permeable and resilient material. As shown in FIGS. 1, 2, and 4, due to the compression of the air permeable mesh material over the larger stiffening ribs 48, the net free area is reduced as the fibers are pressed closer together. However, these areas are localized and only slightly reduce the overall net free area provided for venting.

Figure 3:
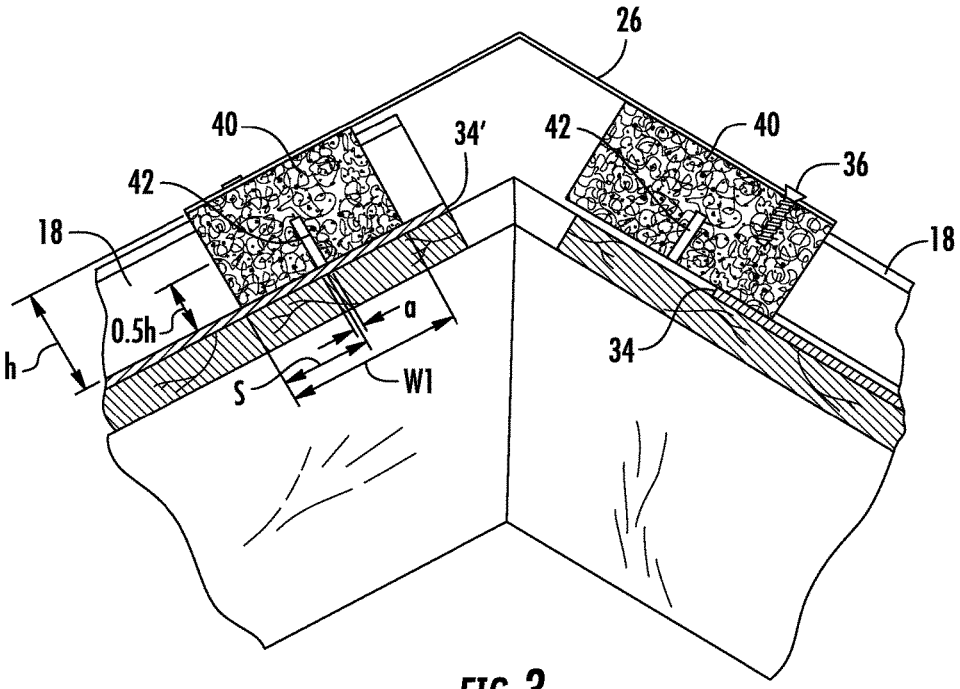
FIG. 3 is a cross-sectional view of a portion of the roof ridge of FIG. 1, showing an embodiment of the roof ridge vent installed thereon. The left-hand side of the figure shows an alternative positioning of the vent strip relative to the edge of the metal roof.

As seen in FIGS. 3 and 4, the relative position of the strip 40 to the upper edge 34 of the roofing panels 18 can vary and still meet the objective of this invention. The right-hand side of FIGS. 3 and 4 show the strip 40 extending beyond the upper edge 34 of the metal panels 18. As seen in FIG. 3, the strip 40 overlaps slightly the vent slot 20 in the ridge 22. The left-hand side of FIGS. 3 and 4 show the strip 40 located slightly below or downward from the upper edge 34' of the metal panels 18.

The vent strip 40 is not profiled or cut, and rather is formed with a higher resiliency and a greater net free area than the prior known non-woven mesh vent strips so that it can be compressed in the area of the projections 28 and is able to conform to the roof panels 18 and fill the spaces between the projections 28. The use of specific widths W1, W2 in connection with certain roof pitches, as well as the use of the groove(s) 42, provides further improvements in preventing the entry of WDR and USR. The vent strip 40 meets the present building requirements for preventing wind driven rain entry through the ridge vent system 10, and also generally prevents the entry of debris and insects.

Preferably, the vent strip 40 is secured in proximity to an upper edge of the roofing panels 18 and overlies the projections 28, and is secured to the roofing panels 18 by an adhesive. The ridge cap 26 is secured to the roofing panels 18 by a series of fasteners 36, such as screws, preferably into one of the larger stiffening ribs 48 as seen in FIG. 3.

Figure 5:
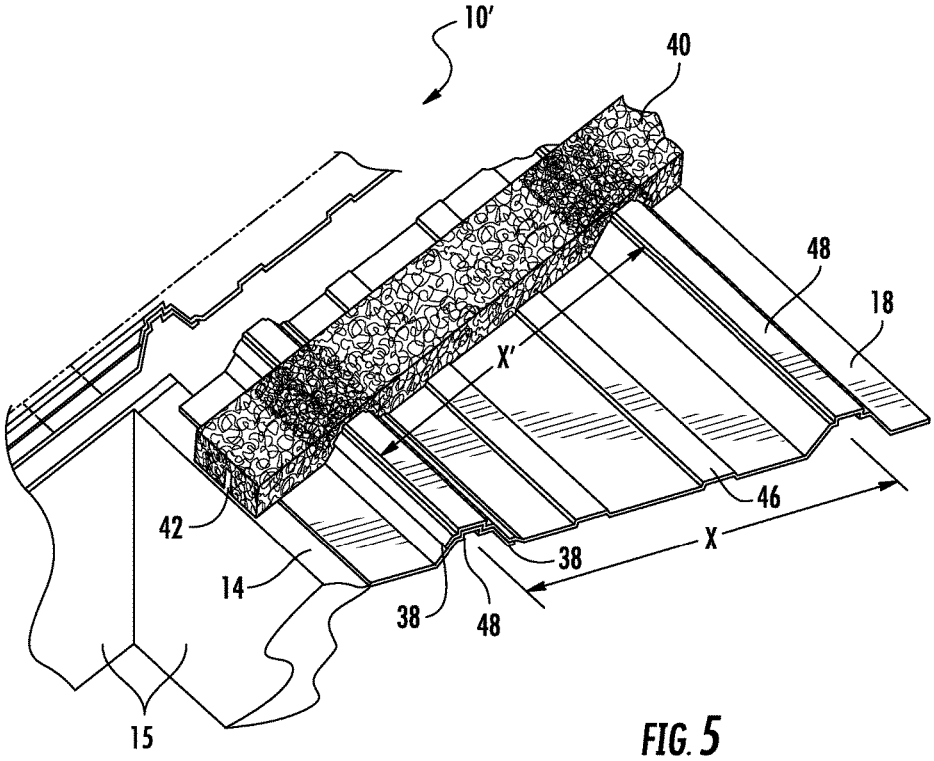
FIG. 5 is an enlarged perspective view of the air permeable and resilient strip positioned as a hip ridge vent on a corrugated metal roof shown with the same projections or ribs as in the ridge vent installation in FIGS. 1-4 with the vent strip being arranged at an angle relative to the ribs.

Referring to FIG. 5, a further benefit of the present vent strip 40 is that it can be used in connection with a hip ridge vent system 10' since it can conform to the angle of the projections in the roofing panel 18 at the roof hip, which by definition would not be at 90°. This addresses a need that the vent strip of U.S. Pat. No. 5,561,953 could not meet in that the length of the vent strip 40 between the projections, illustrated as X' in FIG. 5 changes depending on the angle of the roof hip from the nominal distance X at 90°. Further, the path of the projections through the vent strip 40 is at an angle, meaning that it would not be economically feasible to attempt to form the vent strips with complementary recesses in accordance with U.S. Pat. No. 5,561,953 for all of the various hip ridge configurations that are possible.

As shown in FIG. 5, the vent strip 40 can conform to the projections 28 of the roofing panel 18 along the path of the hip ridge 44 since it is resiliently compressible, and accordingly allows improved venting for a building structure with a hip roof.

Preferred versions of the vent strips 40 prior to installation are shown in FIG. 6. Here, it can be seen that the material is generally uniform, in comparison to the compression of the air permeable mesh material over the larger stiffening ribs 48, as shown in FIG. 5.

An additional advantage is that the same vent strip 40 can be used to vent a roof ridge and a hip ridge, and further can be used as a universal vent strip for corrugated roofing panels or roofing panels with projections falling within a certain size range—for example, the preferred embodiment described above can be used in connection with roofing panels having projections of 1 inch or less. The thickness of the vent strip 40 could be modified to accommodate other size ranges of roofing panel ribs or projections, for example, the thickness could be increased to 2.2 to 2.5 inches for roofing panels with projections having a depth of 2 inches. Here the depth of the groove 42 can also increase to up to 75% for a height of 2" or greater, and is preferably at least 0.5*h. Similar adjustments can be made for other height ribs or projections.

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

What is claimed is:

1. A roof ridge and hip ridge vent system for contoured roofs, comprising:

a vent slot located through a roof structure along at least one of a roof ridge or hip ridge, the roof ridge having a ridge length and the hip ridge having a hip length, the vent slot defining a first side of the roof structure and a second side of the roof structure;

a contoured roofing material having upwardly directed projections that forms a roof surface;

a first vent strip located on the roof surface on the first side of the roof structure extending along the vent slot for the ridge length or the hip length, and a second vent strip located on the roof surface on the second side of the roof surface and extending along the vent slot for the ridge length or the hip length, the first and second vent strips having respective top and bottom surfaces and comprising synthetic fibers that are randomly aligned into an open web by an air flow and then joined by a phenolic or latex binder that is heat cured to form an air permeable mesh material having a generally uniform thickness, a density of about 0.08 to 0.1 grams per cubic centimeter (1.3 to 1.6 grams per cubic inch), and a crush recovery of at least 80%, each of the first and second vent strips comprising a respective first longitudinally extending groove, arranged parallel to the roof ridge or hip ridge, extending for the roof length or the hip length and from the respective bottom surface to about 40% to 60% of a height of the respective vent strip in an uninstalled state, the respective first longitudinally extending groove being located a distance of at least about 1 inch from a downslope side of the respective vent strip, each of the first and second vent strips resiliently compressible such that a space between the respective projections in the contoured roofing material is filled with the respective vent strip, and a portion of the respective strip is compressed into contact with and extends over the respective projections, with some of the fibers being moved or compressed into the respective first longitudinally extending groove in an area of the respective projections; and a cap overlying the slot and the first and second vent strips.

2. The roof ridge and hip ridge vent system for contoured roofs of claim 1, wherein a height of each of the first and second vent strips is in a range of 1 to 1.5 inches.

3. The roof ridge and hip ridge vent system for contoured roofs of claim 1, wherein each first longitudinally extending groove has a groove width that is at least about 0.12 inches to about 0.25 inches.

4. The roof ridge and hip ridge vent system for contoured roofs of claim 1, wherein each first longitudinally extending groove extends from the respective bottom surface about 50% of the height of the respective vent strip.

5. The roof ridge and hip ridge vent system for contoured roofs of claim 1, wherein each of the first and second vent strips comprise a respective second longitudinally extending groove extending from the respective bottom surface of the respective vent strip and is spaced upslope from and apart a nominal distance S from the respective first longitudinally extending groove, and S is at least about 1 inch.

6. The roof ridge and hip ridge vent system for contoured roofs of claim 5, wherein the first and second vent strips with the respective first and second longitudinally extending grooves are adapted for roofs having a roof pitch of less than 5/12.

* * * * *